US005325560A

United States Patent [19]

Pavone et al.

[11] Patent Number: 5,325,560

[45] Date of Patent: Jul. 5, 1994

[54] ORTHODONTIC TOOTHBRUSH

[76] Inventors: Bernadino J. Pavone, 8986 Hackberry, Plymouth, Mich. 48170; John A. Venditti, 47565 Gratiot, Mt. Clemens, Mich. 48045

[21] Appl. No.: 2,219

[22] Filed: Jan. 8, 1993

[51] Int. Cl.[5] ..... A46B 9/04; A46B 17/08; A46B 7/06

[52] U.S. Cl. ..... 15/106; 15/167.1; 15/201; 15/246; 15/DIG. 5

[58] Field of Search ..... 15/106, 167.1, 167.2, 15/201, 207.2, 246, DIG. 5, DIG. 6, 167.3, 110; D4/104, 105, 106, 107, 108, 109, 110, 111, 112

[56] References Cited

U.S. PATENT DOCUMENTS

| | | | |
|---|---|---|---|
| 624,055 | 5/1899 | Lawrence | 15/246 |
| 890,143 | 6/1908 | Kuzzer . | |
| 1,642,465 | 9/1927 | Sheetz . | |
| 1,901,646 | 3/1933 | Hicks . | |
| 1,914,240 | 6/1933 | Caldwell . | |
| 1,950,767 | 3/1934 | Abbott . | |
| 1,993,662 | 3/1935 | Green | 15/167.1 |
| 2,253,210 | 8/1941 | Psiharis | 15/167.1 |
| 2,668,308 | 2/1954 | Grossman | 15/106 |
| 2,797,424 | 7/1957 | Olson . | |
| 2,882,544 | 4/1959 | Hadidian | 15/167.1 |
| 2,935,755 | 5/1960 | Leira | 15/167.1 |
| 3,229,318 | 1/1966 | Clemens . | |
| 3,678,528 | 7/1972 | Haije . | |
| 4,033,008 | 7/1977 | Warren et al. . | |
| 4,240,452 | 12/1980 | Jean | 15/201 |
| 4,356,585 | 11/1982 | Protell et al. . | |
| 4,382,309 | 5/1983 | Collis . | |
| 4,493,125 | 1/1985 | Collis | 15/167.2 |
| 4,694,844 | 9/1987 | Berl | 15/167.1 |
| 4,706,322 | 11/1987 | Nicolas . | |
| 5,040,260 | 8/1991 | Michaels | 15/207.2 |
| 5,184,368 | 2/1993 | Holland | 15/201 |
| 5,201,092 | 4/1993 | Colson | 15/167.1 |
| 5,230,118 | 7/1993 | Chamma | 15/167.1 |

FOREIGN PATENT DOCUMENTS

| | | | |
|---|---|---|---|
| 655526 | 1/1938 | Fed. Rep. of Germany . | |
| 1057279 | 3/1954 | France . | |
| 1100290 | 9/1955 | France . | |
| 1132337 | 3/1957 | France . | |
| 8500178 | 8/1986 | Netherlands . | |
| 266327 | 4/1950 | Switzerland . | |
| 324623 | 11/1957 | Switzerland . | |
| 672052 | 10/1989 | Switzerland | 15/167.1 |
| 1725817 | 4/1992 | U.S.S.R. | 15/167.1 |
| 438858 | 11/1935 | United Kingdom . | |

*Primary Examiner*—Timothy F. Simone
*Assistant Examiner*—Randall E. Chin
*Attorney, Agent, or Firm*—Harness, Dickey & Pierce

[57] ABSTRACT

A toothbrush for use by wearers of orthodontic appliances comprises an elongated handle, a neck and a head. The bristles are designed so that the outermost rows are relatively soft and of long length, the bristles in the pattern gradually shortening in length and becoming stiffer, with the shortest and stiffest bristles being positioned along the center rows of the brush's longitudinal centerline axis. Also, the center rows of bristles are formed to be angled at their ends to reduce the pressure required to deflect the bristles beneath brace elements thus reducing undue pressure against the gums. Furthermore, a flexible member compressibly supports the center rows of bristles. The toothbrush also comprises an outer bumper protectively surrounding the toothbrush head. Moreover, a further embodiment of the invention has a lower tuft of bristles projecting from the lower portion of the handle.

15 Claims, 2 Drawing Sheets

ORTHODONTIC TOOTHBRUSH

BACKGROUND OF THE INVENTION

This invention relates generally to toothbrushes, and specifically to toothbrushes for use by wearers of various orthodontic devices such as braces.

Considerable difficulty has been encountered by wearers of orthodontic devices in keeping the teeth clean and free from plaque by brushing with conventional toothbrushes. It is difficult to apply enough pressure to overcome the impeding effect of the braces without injuring the gums and to obtain thorough access to all of the exposed tooth surfaces with the conventional toothbrush bristles. Sufficient pressure must be applied to the bristles so as to reach behind the brace elements. Furthermore, the presence of braces require a back and forth brushing motion which creates undue pressure, thus tending to result in pyorrhea.

SUMMARY OF THE INVENTION

In accordance with the present invention, a toothbrush containing an elongated handle, a neck and a head has a bristle design and pattern which promotes effective brushing of the teeth while minimizing damage to the gums and allows for effective brushing action on all of the tooth surfaces despite the presence of orthodontic devices. The bristles are designed so that the outermost rows are relatively soft and of long length, the bristles in the pattern gradually shortening in length and becoming stiffer, with the shortest and stiffest bristles being positioned along the center rows of the brush's longitudinal centerline axis. Also, the center rows of bristles are formed to be angled at their ends to reduce the pressure required to deflect the bristles beneath the brace elements thus reducing undue pressure against the gums. Furthermore, a flexible member compressibly supports the center rows of bristles. This reduced pressure avoids the tendency to develop pyorrhea disease.

The present invention is also comprised of an outer bumper protectively surrounding the toothbrush head. Moreover, a further embodiment of the invention has a lower tuft of bristles projecting from the lower portion of the handle. Therefore, the present invention not only protects the user's gums but also protects the orthodontic devices.

BRIEF DESCRIPTION OF THE DRAWINGS

The objects and features of the invention will become apparent from a reading of a detailed description taken in conjunction with the drawings, in which.

DETAILED DESCRIPTION

Figure 1:
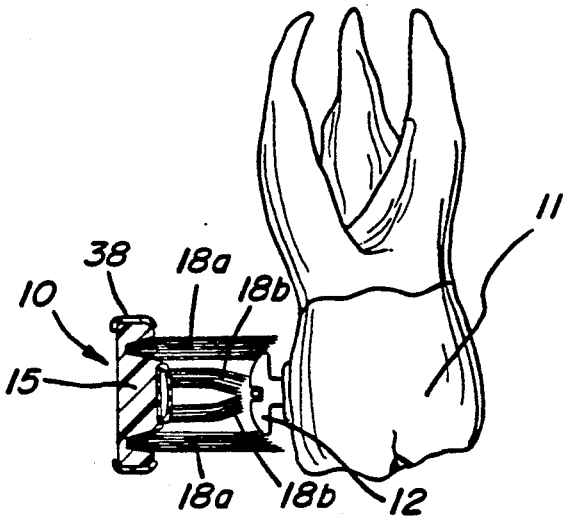
FIG. 1 depicts the toothbrush of the present invention in relation to an orthodontic device and tooth.
Figure 2:
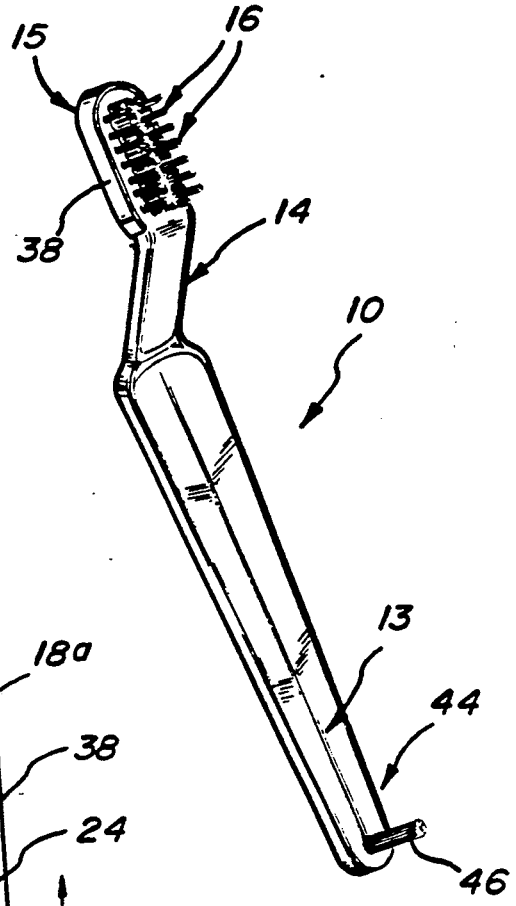
FIG. 2 is a side perspective view showing the preferred embodiment of a toothbrush arranged in accordance with the principles of the invention.

FIGS. 2-5 show a toothbrush 10 arranged in accordance with the principles of the present invention. In its preferred application, the toothbrush 10 is used primarily for brushing teeth 11 with orthodontic devices such as braces 12; this is shown in FIG. 1. Referring to FIG. 2, the toothbrush 10 consists of an elongated handle 13, a neck portion 14, and a head 15 positioned thereabove. The head 15 and the neck 14 are preferably angled inward from the handle 13. This allows for easy access to the inside of the teeth 11.

Figure 3:
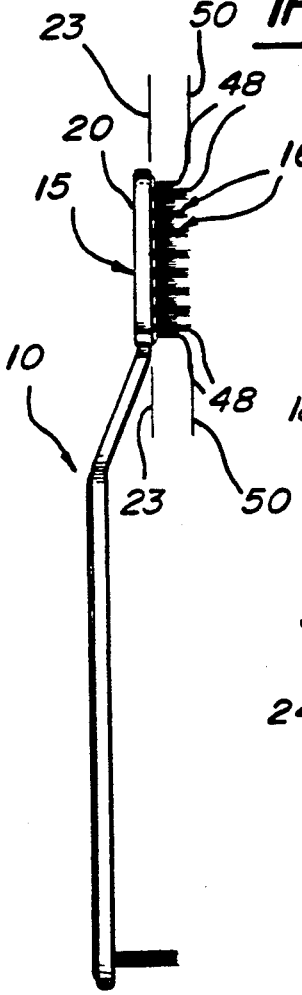
FIG. 3 is a side view of the embodiment of FIG. 2.
Figure 4:
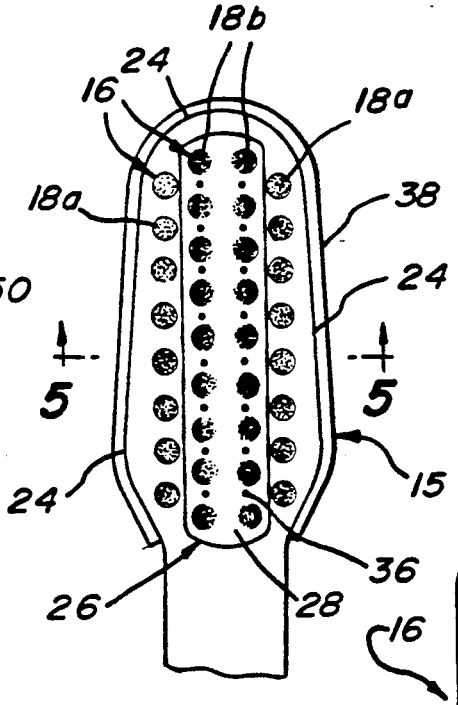
FIG. 4 is a fragmentary view of the toothbrush head taken from FIG. 2 showing a first embodiment flexible member.
Figure 5:
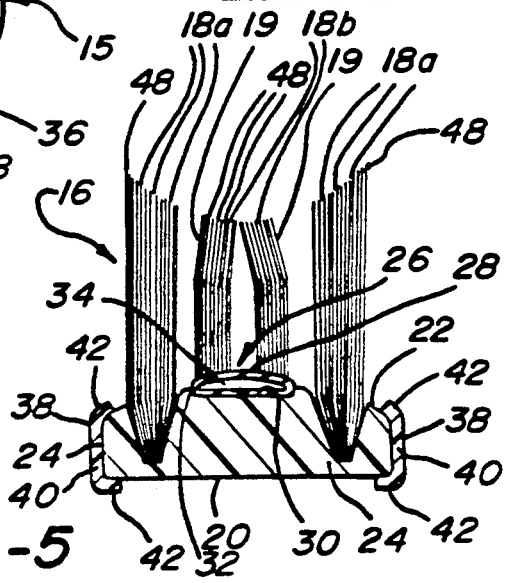
FIG. 5 is a sectional view of the embodiment taken along line 5—5 of FIG. 4.

As can be seen in FIGS. 3-5, the head 15 has an inside surface 22 and an outside surface 20, both of which are peripherally surrounded and connected by a sidewall 24. The toothbrush 10 is preferably molded from a polymeric material. Tufts 16 containing a plurality of bristles 18 are molded within the head 15 and project outwardly from the inside surface 22. The bristles 18 are preferably of a nylon material. The tufts 16 of bristles 18 are arranged in a series of rows, thus forming a pattern upon the inside surface 22. The length of the individual bristles 18 gradually vary from a maximum at the outermost rows **18*a* to a minimum length at the medial rows 18*b* centrally located therein. Coincidentally, the bristle 18 stiffness is selected to be at a minimum at the outermost rows 18*a* and gradually increase in stiffness to a maximum toward the center rows 18*b*. The outer bristles 18*a* contact with the tooth surface 11 above and below the orthodontic device 12, as well as penetrate the spaces between these devices 12. The shorter and stiffer bristles 18*b* may become forced into relatively firm pressure against the tooth surfaces overlain by these braces 12. As depicted in FIG. 5, the central two rows of bristles 18*b* have an angled portion 19 permanently formed inward toward the longitudinal axis or centerline of the toothbrush 10. The base of these central bristles 18*b* extends perpendicularly from a plane normal to the inside surface 22 of the toothbrush head 15 and the inwardly angled portion 19 begins at a point at least halfway up the bristle. This configuration makes it much easier to deflect the tips of the bristles 18*b* beneath the brace elements 12 by the application of relatively moderate pressure against the tooth surface 11**.

In the preferred embodiment, the outermost bristles **18*a* are mounted perpendicular to a plane 23 (FIG. 3) substantially parallel to the inside head surface 22 and are not angled outward as has been shown in various other patents such as: U.S. Pat. No. 2,797,424, "Toothbrush", to Olson; U.S. Pat. No. 1,901,646, "Toothbrush", to Hicks; U.S. Pat. No. 1,642,465, "Tooth And Massage Brush", to Sheetz; U.S. Pat. No. 890,143, "Brush For Cleaning Artificial Sets of Teeth", to Kuzzer; French No. 1,100,290 to Guzman; and, French 1,057,279 to Grignon. An end plane 50 created by the ends 48 of the outermost bristles is substantially parallel to the plane 23 when observed in the side view, as shown in FIG. 3**.

A flexible member 26 comprises a synthetic elastomeric material which retains the centrally located bristles **18*b* is preferably mounted to the inside surface 22. One embodiment of this flexible member 26 is shown in FIG. 5. This first embodiment flexible member 26 is comprised of a top surface 28 and a bottom surface 30, both of which are longitudinally bordered and connected by sidewalls 32**. The ends of the flexible member 26 are open until located within the head 15. This flexible member 26 serves to form an air pocket 34 therewithin. As can be seen in FIG. 4, this flexible member 26 contains a plurality of holes 36 within its top surface 28. This allows the air 34 to be compressibly released when the central bristles 18*b* are compressed toward the inside surface 22 of the toothbrush head 15.

Figure 6:
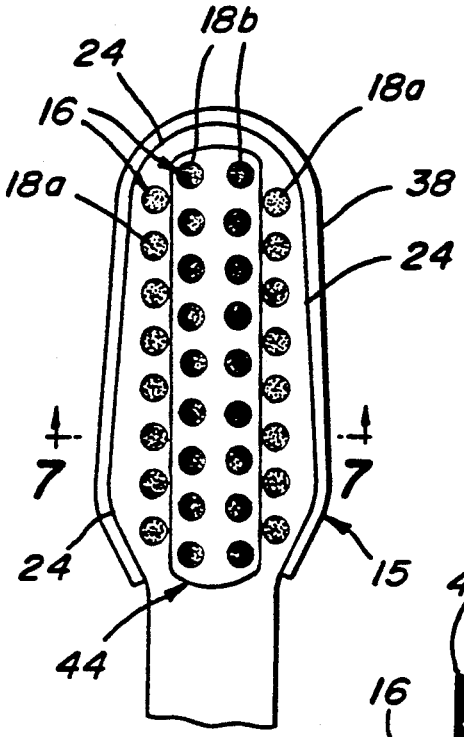
FIG. 6 is a fragmentary view of the toothbrush head taken from FIG. 2, showing an alternative embodiment flexible member.
Figure 7:
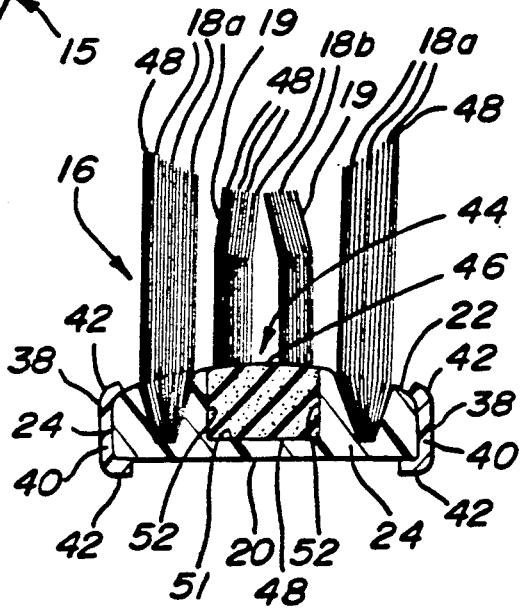
FIG. 7 is a sectional view of the alternative embodiment taken along line 7—7 of FIG. 6.

Referring to FIGS. 6 and 7, a second embodiment of a flexible member 44 is shown. The flexible member 44 is envisioned to be a solid block of spongy material. This material may have voids or air bubbles therewithin. The flexible member 44 has a top surface 46 from which the center rows of bristles 18*b* extend. The flexible member 44 is bounded by toothbrush head inside walls 52 and is supported by an inside lower wall 51.

Figure 8:
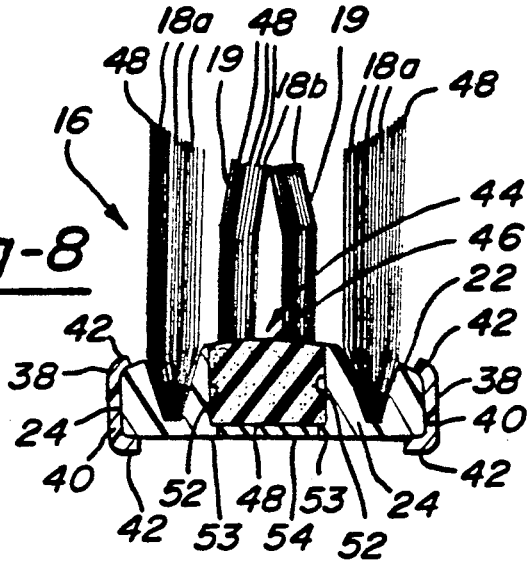
FIG. 8 is a sectional view of a third embodiment flexible member also taken along line 7—7 of FIG. 6.

FIG. 8 depicts a third embodiment of the flexible member 44 whereby a central portion of the head's outside surface 20 is removed therefrom to form an opening. Thus, a bottom surface 48 of the flexible member 44 is visible. Ledges 53 are formed around the opening and are integral with the head's outer surface 20; these ledges 53 serve to support the outermost portions of the flexible member 44 when the flexible member 44 is compressed. Additionally, a transparent polymeric material can be inserted into this central opening to form a transparent window 54.

As is shown in FIGS. 4 and 5, the preferred embodiment of the present invention toothbrush also incorporates a bumper 38 comprising a synthetic elastomeric material which encapsulates a portion of the toothbrush head 15. The bumper 38 preferably has a cross sectional U-shape with a center portion 40 therein, and having outboard return flange portions 42 thereupon. The center portion 40 is attached to the side wall 24 and the bumper return flanges 42 are attached to the outermost edges of the inside surface 22 and the outside surface 20. The bumper 38 serves to protect the orthodontic devices 12 during normal brushing of the teeth.

Referring to FIGS. 2 and 3, another feature of the present invention toothbrush encompasses a lower bristle tuft 46 molded within the lower end 44 of the toothbrush handle 13. These bristles 46 can be used to brush in tooth crevices behind the orthodontic devices 12. The lower bristles 46 are preferably molded from the same material as the bristles 18 in the head 15.

It will be appreciated that the toothbrush of the present invention represents a significant improvement for brushing of teeth having attached orthodontic devices. While a number of specific embodiments of this toothbrush have been disclosed, it will be appreciated that various modifications may be made to this toothbrush without departing from the present invention. For example, the bumper, surrounding the head, may be of a different cross sectional shape than the U-shape cross section described. Also, while specific outside and center rows of bristle tufts have been described, these rows may vary in number and still be within the scope of the present invention. While various materials have been disclosed in exemplary fashion, various other materials may of course by employed. It is intended by the following claims to cover these and any other departures from the disclosed embodiments which fall within the true spirit of this invention.

The invention claimed is:

1. A toothbrush comprising:

an elongated handle, an angled neck connected to said elongated handle, a head portion connected to said angled neck longitudinally opposite from said elongated handle and having a longitudinally oriented centerline thereof, said head portion having an inside and an outside surface both of which are peripherally bordered by a sidewall therearound, a plurality of tufts having a plurality of bristles therein, said plurality of bristles being arranged in a pattern projecting transversely from said inside surface of said head portion, said pattern of said plurality of bristles having outside rows and medial rows extending along said center line, said pattern comprising a continuously decreasing length of bristle from an outermost located of said plurality of bristles to a shortest of said plurality of bristles located closest to said centerline of said head portion, said plurality of bristles also gradually varying in stiffness from a minimum stiffness at the outermost located of said plurality of bristles to a maximum stiffness located at the plurality of bristles located closest to the centerline of said plurality of bristles in said pattern, said plurality of bristles in said outside rows being substantially straight along their entire length and projecting perpendicular from a plane substantially parallel to said inside surface of said head portion, said medial rows having lower bristle portions thereupon, said lower bristle portions projecting generally perpendicular from a plane substantially parallel to said inside surface, said medial rows having top portions thereupon, said top portions being angled inward toward said centerline of said head portion; and said outermost located of said plurality of bristles having end portions thereupon thereby creating an end plane, said end plane being substantially parallel to said inside surface.

2. The toothbrush of claim 1 further comprising a flexible member located centrally adjacent to said inside surface, said medial rows being attached to said flexible member and extending therefrom, whereby said flexible member allows said medial rows of bristles to move toward and away from said inside surface of said head portion.

3. The toothbrush of claim 2 wherein said flexible member is a solid block of spongy material.

4. The toothbrush of claim 3 further comprising a cavity centrally formed below said head's inside surface, said cavity having inside walls, said cavity acting to locate and hold said flexible member therewithin.

5. The toothbrush of claim 4 further comprising:

a substantially transparent window, said cavity extending from said head's inside surface to said outside surface, thereby forming an opening centrally located therewithin; and said window being retained within said outside surface opening, whereby said flexible member is visible from both said inside and said outside surfaces of said toothbrush head.

6. The toothbrush of claim 2 wherein:

said flexible member includes a top surface and a bottom surface, both being generally parallel to said head portion's inside surface, said top and said bottom surfaces being peripherally connected by walls extending therebetween, said top and said bottom surfaces being generally separated by an air pocket; and said top surface having a plurality of openings therein, whereby when said medial rows of bristles compress said top surface of said flexible member, said air can escape through in said plurality of openings in said top surface.

7. The toothbrush of claim 6 wherein said flexible member comprises a synthetic elastomeric material.

8. The toothbrush of claim 1 further comprising a bumper located adjacent to and covering said sidewall of said head portion.

9. The toothbrush of claim 8 wherein said bumper has a cross sectional U-shape for fitting snugly against said head portion sidewall and against the outermost portion of said inside surface and said outside surface.

10. The toothbrush of claim 9 wherein said bumper comprises a synthetic elastomeric material.

11. The toothbrush of claim 1 wherein:

said elongated handle has a lower portion remote from said head portion; and a lower tuft having a plurality of bristles therein, said plurality of bristles generally extending perpendicular from said lower portion of said elongated handle.

12. A toothbrush comprising:

an elongated handle, an angled neck connected to said elongated handle, a head portion connected to said angled neck longitudinally opposite from said elongated handle and having a longitudinally oriented centerline thereof, said head portion having an inside and an outside surface both of which are peripherally bordered by a sidewall therearound, a plurality of tufts having a plurality of bristles therein, said plurality of bristles being arranged in a pattern projecting transversely from said inside surface of said head portion, said pattern of said plurality of bristles having outside rows and medial rows, extending along said centerline, said pattern comprising a continuously decreasing length of bristle from an outermost located of said plurality of bristles to a shortest of said plurality of bristles located closest to said centerline of said head portion, said plurality of bristles also gradually varying in stiffness from a minimum stiffness at the outermost located of said plurality of bristles to a maximum stiffness located at the plurality of bristles located closest to the centerline of said plurality of bristles in said pattern, said plurality of bristles in said outside rows projecting perpendicular from a plane substantially parallel to said inside surface of said head portion, said medial rows having lower bristle portions thereupon, said lower bristle portions projecting generally perpendicular from a plane substantially parallel to said inside surface, said medial rows having top portions thereupon, said top portions being angled inward toward said centerline of said head portion, said outermost located of said plurality of bristles having end portions thereupon thereby creating an end plane, said end plane being substantially parallel to said inside surface, a flexible member located centrally adjacent to said inside surface, said medial rows being attached to said flexible member and extending therefrom, whereby said flexible member allows said medial rows of bristles to move toward and away from said inside surface of said head portion; and a bumper having a cross sectional U-shape for fitting snugly against said head portion sidewall and only against the outermost portion of said inside surface and said outside surface so as to be substantially clear of said outside surface of said head portion.

13. A toothbrush comprising:

an elongated handle, a neck connected to said elongated handle, a head portion connected to said neck longitudinally opposite from said elongated handle, said head portion having an inside and an outside surface both of which are peripherally bordered by a sidewall therearound, a plurality of tufts having a plurality of bristles therein, said plurality of bristles being arranged in a pattern projecting from said inside surface of said head portion, said pattern of said plurality of bristles having outside rows and medial rows, a flexible member located centrally adjacent to said inside surface, said medial rows of bristles being attached to said flexible member and extending therefrom, whereby said flexible member allows said medial rows of bristles to move toward and away from said inside surface of said head portion; and said outside rows of bristles being attached to a rigid section of said head portion transversely adjacent to said flexible member.

14. The toothbrush of claim 13 wherein:

said flexible member includes a top surface and a bottom surface, both being generally parallel to said head portion's inside surface, said top and said bottom surfaces being peripherally connected by walls extending therebetween, said top and said bottom surfaces being generally separated by an air pocket; and said top surface having a plurality of openings therein, whereby when said medial rows of bristles compress said top surface of said flexible member, said air can escape through said plurality of openings in said top surface.

15. The toothbrush of claim 13 wherein said flexible member is a solid block of spongy material.

* * * * *